US012196536B2

(12) United States Patent
Wustlich et al.

(10) Patent No.: US 12,196,536 B2
(45) Date of Patent: Jan. 14, 2025

(54) PYROTECHNIC OBJECT

(71) Applicant: Rheinmetall Waffe Munition GmbH, Südheide (DE)

(72) Inventors: Martin Wustlich, Lüdersdorf (DE); Frank Habel, Hohnstorf (DE); Kai Lübbers, Kuddewörde (DE); Ernest Schulz, Hamburg (DE); Dirk Cegiel, Stubben (DE); Robert Fischer, Lenzig (AT)

(73) Assignee: Rheinmetall Waffe Munition GmbH, Südheide (DE)

( * ) Notice: Subject to any disclaimer, the term of this patent is extended or adjusted under 35 U.S.C. 154(b) by 49 days.

(21) Appl. No.: 18/142,651

(22) Filed: May 3, 2023

(65) Prior Publication Data

US 2024/0118062 A1 Apr. 11, 2024

Related U.S. Application Data

(63) Continuation of application No. PCT/EP2021/080098, filed on Oct. 29, 2021.

(30) Foreign Application Priority Data

Nov. 5, 2020 (DE) ..... 10 2020 129 200.7

(51) Int. Cl.
*F42B 3/16* (2006.01)
*F42B 5/16* (2006.01)

(52) U.S. Cl.
CPC . *F42B 3/16* (2013.01); *F42B 5/16* (2013.01)

(58) Field of Classification Search
CPC .. F42B 3/11; F42B 3/128; F42B 27/08; F42B 4/24; F42B 5/16; F42B 3/16
(Continued)

(56) References Cited

U.S. PATENT DOCUMENTS 3,162,122 A 12/1964 Allen et al.
4,444,111 A * 4/1984 Luebbers ..... F42B 27/00 102/368
(Continued)

FOREIGN PATENT DOCUMENTS

DE 3813039 A1 11/1989
DE 102004059991 A1 6/2006
(Continued)

OTHER PUBLICATIONS

International Search Report from corresponding PCT Application No. PCT/EP2021/080098, dated Feb. 14, 2022.
(Continued)

*Primary Examiner* — John Cooper
(74) *Attorney, Agent, or Firm* — Harness, Dickey & Pierce, P.L.C.

(57) ABSTRACT

The present disclosure relates to a pyrotechnic object, in particular an irritation body, irritation projectile or ammunition, comprising an ignition device, comprising a delay chamber extending along a delay path, in which chamber a delay charge is accommodated, and comprising at least one and preferably a plurality of effect chambers in which or in each of which an effect charge to be ignited is accommodated, wherein the delay chamber is transversely connected to a respective effect chamber via a respective over-ignition opening which branches off from the delay chamber and forms an over-ignition path, wherein in the case of a plurality of effect chambers the plurality of over-ignition openings are arranged successively downstream along the delay path in the order of the effect charges to be ignited.

20 Claims, 2 Drawing Sheets

(58) Field of Classification Search
USPC ..... 102/276
See application file for complete search history.

(56) References Cited

U.S. PATENT DOCUMENTS 4,791,870 A * 12/1988 Simpson ..... C06D 3/00 102/357
4,998,751 A * 3/1991 Paxton ..... B60R 21/2644 280/740
5,983,801 A * 11/1999 Brunn ..... F42B 12/48 102/336
8,091,480 B2 * 1/2012 Lubbers ..... F42B 12/36 102/368
9,016,205 B2 * 4/2015 Lubbers ..... F42B 8/26 102/498
9,989,341 B2 * 6/2018 Robbins ..... F42B 27/00
11,054,231 B2 * 7/2021 Habel ..... F42C 19/0807
2008/0276822 A1 * 11/2008 Lubbers ..... F42B 12/46 102/502
2017/0343330 A1 * 11/2017 Muster ..... F42C 15/34
2019/0316890 A1 * 10/2019 Schmitz ..... F42C 19/0838

FOREIGN PATENT DOCUMENTS

DE 102015014821 A1 5/2017
DE 102016015042 B4 8/2018
WO WO-2006063564 A1 * 6/2006 ..... F42B 12/36

OTHER PUBLICATIONS

Written Opinion from corresponding PCT Application No. PCT/EP2021/080098, dated Feb. 14, 2022.
Office Action from corresponding German Patent Application No. 10 2020 129 200.7, dated Jun. 7, 2021.

* cited by examiner

PYROTECHNIC OBJECT

CROSS-REFERENCE TO RELATED APPLICATIONS

This application is a continuation application of PCT Application No. PCT/EP2021/080098, filed on 29 Oct. 2021, which claims priority to and benefit of German Patent Application No. 10 2020 129 200.7, filed on 5 Nov. 2020. The entire disclosures of the applications identified in this paragraph are incorporated herein by references.

FIELD

The invention relates to a pyrotechnic object, in particular an irritation body, irritation projectile or ammunition, comprising an ignition device, comprising a delay chamber extending along a delay path, in which chamber a delay charge is accommodated, and comprising at least one and preferably a plurality of effect chambers in which or in each of which an effect charge to be ignited is accommodated, wherein the delay chamber is transversely connected to a respective effect chamber via a respective over-ignition opening which branches off from the delay chamber and forms an over-ignition path, wherein in the case of a plurality of effect chambers the plurality of over-ignition openings are arranged successively downstream from the delay chamber along the delay path in the order of the effect charges to be ignited.

Pyrotechnic objects of this kind are widely known. These can be irritation bodies, in particular irritation projectiles having a combined flash/bang effect, optionally with nebulization, and also ammunition in the broadest sense. In order to achieve a time delay between a triggering actuation of the ignition device, in particular and typically by means of a rocker arm ignition device comprising primer caps, and the ignition of the effect charge and in particular a plurality of effect charges one after the other, a delay charge is provided along a delay path. The delay charge, which can comprise in particular one to three delay charges, in particular a lighting charge, a mixed charge and a main charge, has the task of igniting the first effect charge after a defined time of for example 1.5 seconds. The delay charge is typically arranged axially centrally in the delay chamber forming the delay path and in particular pressed therein.

BACKGROUND

A pyrotechnic object in the form of an irritation body having the features of the preamble of claim 1 is known from DE 10 2004 059 991 A1.

DE 38 13 039 A1 discloses a non-generic pyrotechnic object referred to as a delay element having a gas charge, the pyrotechnic object comprising a primer piece having primer caps and a single continuous channel in a longitudinal direction, which channel comprises an ignition channel portion, a portion for a primer charge, a portion for a delay charge, a portion for a transfer charge and a portion for a propellant charge which is to be ignited last. In order to prevent propellant gases from flowing out via the primer piece, a non-return valve having a cone and a ball is provided between the ignition channel portion and the portion for the primer charge. The ball is in this case embedded in the primer charge, the slag of which supports sealing.

DE 10 2016 015 042 B4 relates to a non-generic ammunition module having an explosive assembly in a warhead, an igniter, and an ignition channel which is partially surrounded by the explosive assembly and comprises pyrotechnic material for igniting the explosive assembly. In order to reduce the power loss after ignition of the warhead and to prevent the escape of explosion fumes, it is proposed to use an ignition channel which is self-sealing in the exploding state. This is achieved in the one or more sealing elements in or on the ignition channel. The sealing element can be a body which is introduced into the ignition channel by the at least partially reacted explosive in order to seal it. The body or the sealing element can also be designed as a shell or sleeve surrounding the ignition channel, so that it is compressed by the partially reacted explosive and, together with residual pyrotechnic material, causes the ignition channel to seal.

In addition to the temperature of the combustion front of the delay charge, the firing behavior, i.e., the kinetics of the advance of the combustion front, and the kinetics of the hot particles that travel through the over-ignition opening are also responsible or operationally critical for the proper ignition of the respective effect charge of a pyrotechnic object of the type mentioned at the outset. The firing behavior is influenced, inter alia, by the pressure conditions and the particle properties of the delay charge. (The same applies to the pressure and the particle arrangement within the respective effect charge.)

In the present case, it has been found that, in pyrotechnic objects having a plurality of, in particular more than two, effect charges to be ignited one after the other, which are sometimes referred to as "multi-bang systems," problems occur in that, in particular in the case of a high effect number, malfunctions can occur, i.e., the effect charges in the individual chambers are not ignited or are ignited at an incorrect time.

The problem addressed by the present invention is that of overcoming this problem, i.e., improving the functional safety of the proper ignition of pyrotechnic objects discussed herein in the broadest sense, i.e., also including ammunition.

In a pyrotechnic object of the aforementioned type, this problem is solved according to the invention in that an over-ignition charge that differs and chemically deviates from the respective effect charge is introduced into the over-ignition opening or into the plurality of over-ignition openings, in order to at least partially close the over-ignition opening after its combustion and by its combustion residue, and thereby to reduce or dampen a propagation of a pressure shock which is produced as a result of the ignition of the effect charge in the respective effect chamber and acts on the delay chamber via the respective over-ignition opening.

As the starting point of the development, it has been identified, in a manner in accordance with the invention, that the ignition of the respective effect charges can be disadvantageously influenced by the ignition of preceding effect charges. The ignition of an effect charge leads namely to pressure surges of up to for example 1600 bar that last several milliseconds. These pressure surges or pressure shocks are capable of having an impact back on the delay path through the over-ignition opening assigned thereto. This leads to the still unfired delay charges being acted upon in an uncontrolled manner, specifically with regard to thermal action and mechanical action as a result of an extreme pressure increase. This disadvantageously influences the prepared arrangement of the combustible material of the delay charge. In individual cases, this can lead to the combustion front being destroyed, i.e., to the delay charge being extinguished, or the compressed delay charge penetrating to one or more of the subsequent over-ignition openings and thus to their associated effect charges, which leads to an uncontrolled multiple ignition of effect charges. However, it is also possible, as a result of the pressure shock, for the burning delay charge to rapidly burn past the subsequent over-ignition opening and effect chamber, without igniting the effect charge. This effect charge is then left behind in the pyrotechnic object as an explosion charge that is potentially dangerous because it has not ignited. The surface geometry of the combustion front of the delay charge can also be changed by the pressure shock such that skewed burn-off takes place, which can likewise impair proper ignition of the effect charges. Local compression of the effect charge itself as a result of the pressure shock from the ignition of preceding effect charges also promotes the occurrence of malfunctions, for example if the material of the effect charge is no longer located directly at or behind the mouth of the over-ignition opening due to the propagation of a pressure shock through the over-ignition opening of a subsequent effect chamber.

The present invention proposes deliberately introducing an over-ignition charge that is different from the effect charge into a respective over-ignition opening, at least along part of the ignition path formed thereby. This reduces the risk of failed ignitions because the combustion front can reliably propagate through a respective downstream over-ignition opening, effectively guided by the over-ignition charge. However, another important aspect is that the combustion residue that remains immediately after the over-ignition charge has burnt off is capable of at least partially closing the over-ignition opening, with the result that the subsequent pressure shock caused by the ignition of the effect charge is reduced in terms of its effect on the delay chamber and the delay charge located therein.

It proves advantageous here if the burn-off of the over-ignition charge is accompanied by the greatest possible slag formation and over-ignition performance, since filling material for filling and sealing the over-ignition opening is formed thereby. The material of the over-ignition charge can be formed, for example, by a delay and primer charge material according to DE 10 2015 014 821 A1; the relevant content of this document, i.e., the composition of the primer or delay charge material, is incorporated by way of reference in this document into the contents of the present application.

In accordance with the invention, it has therefore been recognized that, by specifically filling at least part of the over-ignition opening or over-ignition path with an over-ignition material in the form of a delay and primer charge material which preferably forms a high level of slag, the effects of pressure shocks and their repercussion on the still burning delay chamber can be reduced, and that an improvement can be brought about for the further ignition behavior, at least with regard to the critical consequences thereof.

As a result of the fact that an over-ignition charge is arranged in the over-ignition opening, the over-ignition distance is also reduced, i.e., the over-ignition charge is brought closer to the effect charge and therefore the amount of hot particles which reach the effect charge is also increased. Both lead to an increase in the reliability of the ignition of the effect charge. The intensity of the over-ignition itself and thus the safety of the ignition of the effect charge is increased by the increased number of particles and the smaller distance from the effect charge.

It proves advantageous here that the over-ignition charge is introduced into the over-ignition opening over at least 20%, in particular over at least 30%, in particular over at least 40%, in particular over at least 50% and in particular over 100%, in particular over at most 90%, in particular over at most 80%, in particular over at most 70% of the length of the over-ignition path. Taking into consideration, for example, a conventional extension of the over-ignition path formed by the over-ignition opening of 5-12 mm, introduction over 30-100% of the length of the over-ignition path proves to be preferable.

In order to consistently arrange the over-ignition charge as intended and in as defined a manner as possible with regard to its physical arrangement parameters, such as compression and porosity, it proves advantageous if the over-ignition charge is pressed into the over-ignition opening. This can be achieved in any manner and, with regard to economic manufacturability, preferably by means of a plunger introduced from radially outside.

Furthermore, it can prove advantageous if the over-ignition charge is introduced into the over-ignition opening as a pasty or at least still flowable medium and is cured therein.

In a particularly meaningful development of the invention, it is proposed that the over-ignition opening has a cross-sectional change along the over-ignition path. As a result of a cross-sectional change, in particular a widening or tapering of the over-ignition opening, the over-ignition charge introduced into the over-ignition opening can be better anchored in the over-ignition opening. This applies in particular to the combustion residue of the over-ignition charge after it has burnt off. As a result, the sealing effect or damping effect of the combustion residue of the over-ignition charge can be further improved.

In particular, it can prove advantageous if a cross-sectional area of the over-ignition opening changes along the over-ignition path, i.e., in the ignition propagation direction, by at least 10%, in particular by at least 20%, in particular by at least 25%, in particular by at most 60%, in particular at most 50%. Expansion or tapering caused thereby can be occur along a continuous or discontinuous course, in particular in a stepped or conical shape or even in a rounded shape.

In any case, it proves advantageous if the cross-sectional change is oriented such that the over-ignition opening has, in the ignition propagation direction, an increasing cross-sectional area, i.e., a widening cross section. This specifically means that the combustion residue of the over-ignition charge is compressed further by the immediately subsequent pressure shock, and the over-ignition opening that tapers in the direction of propagation of the pressure shock is suddenly preferably completely sealed. The combustion residue can then become wedged in an over-ignition opening which tapers in the direction of propagation of the pressure shock in particular in a conical or funnel shape, and closes it like a plug.

In this case, it proves advantageous if the over-ignition charge is arranged, as viewed in the longitudinal direction of the over-ignition path, in the region of the cross-sectional change of the over-ignition opening such that the immobilization and anchorage of its combustion residue is assisted by the cross-sectional change.

It also proves advantageous that a housing inner body which forms the chambers and an outer, in particular cylindrical, sleeve body surrounding the housing inner body are present, which sleeve body forms a grippable outer side of the object and preferably seals further assembly openings which are still open or uncovered and which communicate with the chambers by means of optional sealing elements. By means of the sleeve body, the interior of the chambers can be effectively protected against environmental influences, in particular penetrating moisture.

Further features, details and advantages of the invention will become apparent from the appended claims and the drawings and the following description of an exemplary embodiment of the invention. In the drawings:

DETAILED DESCRIPTION

Figure 1:
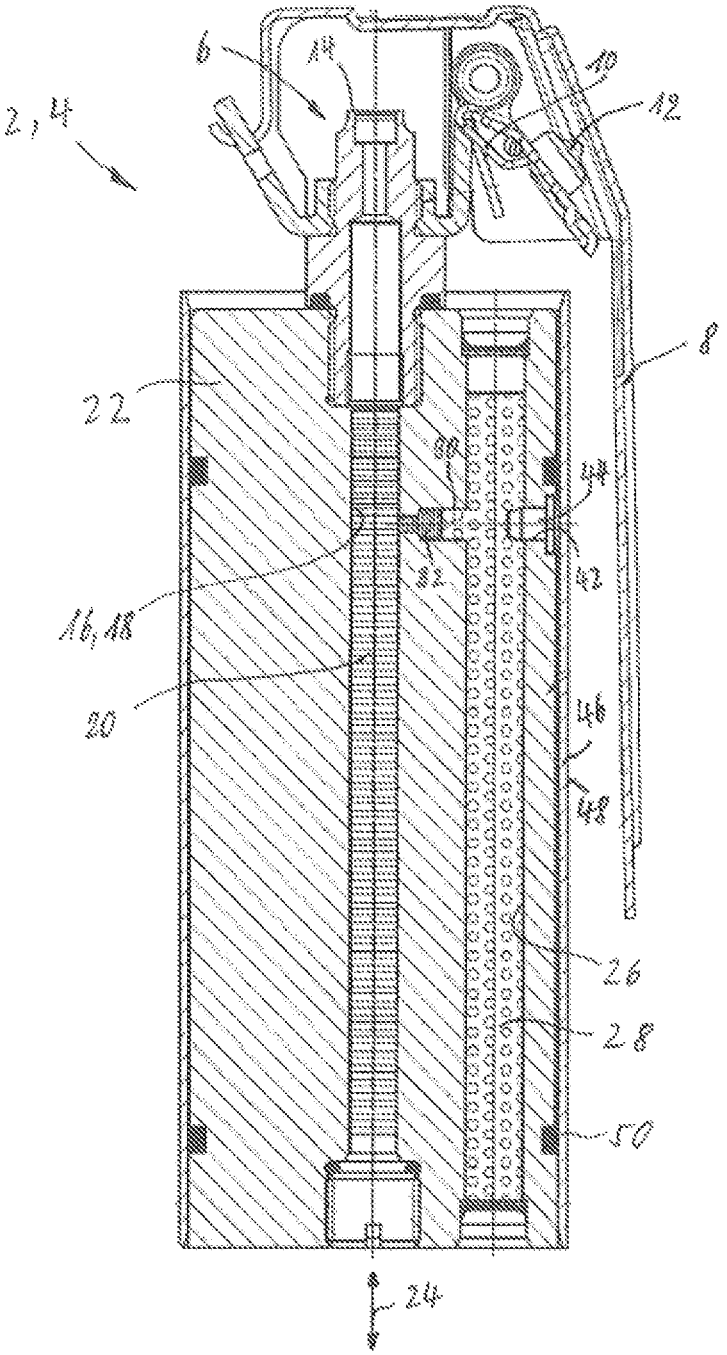
FIG. 1 is a longitudinal sectional view of a pyrotechnic object designed according to the invention.

The pyrotechnic object 2 which is shown in the figures and designed according to the invention, for example in the form of a BTV ("bottom top venting") irritation projectile 4 (i.e., which has the blow-out direction upwards and downwards or in axially opposite directions), comprises an ignition device 6 of a design that is known per se. The ignition device 6 comprises a manually holdable or pressable and releasable rocker arm 8, a pull-off securing ring (not shown), a spring 10, a striking piece 12 and a primer cap 14 which are of a design that is already known, and which are therefore not described in more detail. A delay chamber 16, which is designed in this case for example as a bore, extends axially below the primer cap 14 along a delay path 18 in which at least one delay charge 20 is arranged. In the case shown by way of example, the delay chamber 16 extends along an axial longitudinal direction 24 within, specifically centrally within, a housing inner body 22 which is shown by way of example as solid, and in so doing forms and thus delimits the delay path 18. Effect chambers 26 which also extend in the axial longitudinal direction 24 and are arranged in the manner of a revolver and concentrically with respect to the delay chamber 16 are provided radially outside the delay chamber 16, but only one of these corresponding to the sectional plane is shown in FIG. 1. An effect charge 28 to be ignited is present in each of the effect chambers 26, preferably in the form of a uniformly introduced particle material.

In this application, when an effect charge or an effect charge material is mentioned, this can be, for example, a flash charge and/or a bang charge and/or a smoke charge as an explosive.

A respective effect chamber 26 is connected to the centrally arranged delay chamber 16 via a respective over-ignition opening 30. The over-ignition opening 30 is designed in this case as a bore. As intended, a combustion front of the delay charge 20 is meant to propagate along the delay path 18 in the axial longitudinal direction 24 starting from the ignition device 6. When the combustion front reaches the first or a subsequent over-ignition opening 30, for example branching off radially in this case, the effect charge 28 is intended to be ignited in the intended manner in the associated effect chamber 26 by igniting through this over-ignition opening 30. In this case, in FIG. 1, the effect charge which explodes by ignition is ejected, together with the intended effect associated therewith, upwards and downwards in the axial longitudinal direction 24 as intended.

At the same time, the combustion front also propagates axially in the delay chamber 16 until it reaches the next over-ignition opening 30 in the direction of the delay path 18 and, in the same way, as intended, causes an ignition of the effect charge 28 in the associated effect chamber 26.

While the over-ignition opening 30 has since been left open, so that the ejected hot particles of the combustion front could propagate as unimpeded as possible through the over-ignition opening 30 into the associated effect chamber 26 and could lead to the ignition of the effect charge 28 provided therein, it is now proposed according to the invention that an over-ignition charge 32 is deliberately introduced into the over-ignition opening 30, specifically at least along part of the extension of the over-ignition opening 30 or the over-ignition path 34 formed thereby (FIG. 2), which is effective for the purposes to be illustrated below. The introduction of the over-ignition charge 32 into the over-ignition opening 30 makes it possible to also ensure that significantly more hot particles propagate through the over-ignition opening 30 towards the effect chamber 26 and lead to the reliable ignition of the effect charge 28. Furthermore, a combustion residue 36 within the region 38 of the over-ignition opening 30 in which the ignition charge 32 is or was arranged is produced by the over-ignition charge 32 burning off. The combustion residue 36 therefore preferably comprises a not insubstantial portion of slag which can stop and become wedged within the over-ignition opening 30. When the effect charge 28 is ignited, a considerable pressure shock is produced which propagates not only in the axial longitudinal direction 24 but also through the over-ignition opening 30. This pressure shock results in a compression of the combustion residue 36 within the over-ignition opening 30 in a manner according to the invention. This means that the combustion residue 36 helps to reduce or dampen the effects and propagation of the pressure shock through the over-ignition opening 30 back towards the delay chamber 16. This proves to be advantageous in terms of the improvement of the reliability of the intended ignitions of the effect charges in order, as shown in detail in the introduction.

Figure 2:
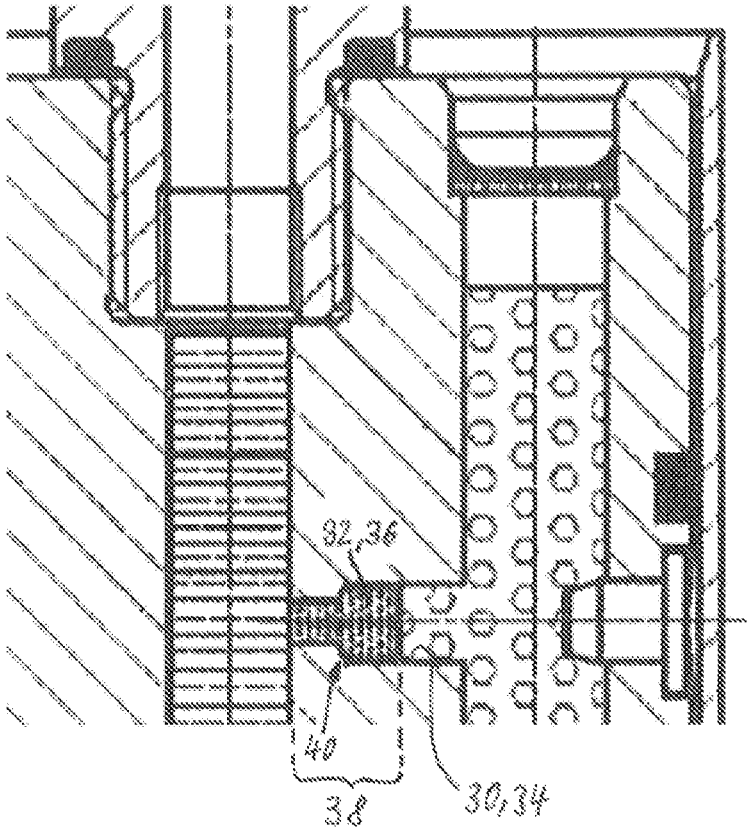
FIG. 2 shows an enlarged detail from FIG. 1.

As can be seen from the figures, the over-ignition opening 30 has a cross-sectional change 40 along the extension of the over-ignition path 34, and the cross-sectional change 40 is preferably oriented such that the over-ignition opening 30 has, in the ignition propagation direction, i.e., towards the effect chamber 26, an increasing cross-sectional area. In FIG. 2, the cross-sectional change 40 is conical or funnel-shaped. This shape can be formed, for example, in the form of a recessed bore, by a radial bore being introduced into the housing inner body 22 from radially outside, first using a drill having a small diameter and then a drill having a larger diameter. In this case, the shape of the cross-sectional change 40 can also be achieved by machining. In the case shown by way of example, access from radially outside is achieved through a further radial opening 42 in the housing inner body 22, which is then closed by a blind rivet 44. The housing inner body 22 receives, radially outside, a cylindrical sleeve body 46 which forms a manually grippable outer side 48 of the object 2 and, by way of example, securely seals the further radial openings 42 against environmental influences by means of two O-ring seals 50.

If the over-ignition charge, as shown, is arranged in the region of the cross-sectional change 40 and is preferably immobilized there, the effect of the combustion residue 36 of the over-ignition charge 32 that reduces or damps the pressure shock is particularly effective. As a result of the pressure shock, the combustion residue 36 is, as also already shown at the outset, partially compressed, as a result of which the particles of the combustion residue 36 in the over-ignition opening 30 become wedged against each other and become an obstacle that is more difficult to overcome by pressure. As a result, the delay charge 20 located in the delay chamber 16 and its intended further advancing combustion front are better protected from the effects of the pressure shock. This makes it possible to significantly improve the functional safety and reliability of the ignition of the following effect charges 28.

What is claimed is:

1. A pyrotechnic object comprising:

an ignition device;

a delay chamber for housing a delay charge, the delay chamber extending from the ignition device along a delay path; and at least one effect chamber accommodating an effect charge to be ignited, the delay chamber transversely connected to the effect chamber via an over-ignition opening which branches off from the delay chamber and forms an over-ignition path between the delay chamber and the effect chamber, wherein an over-ignition charge that differs and chemically deviates from the effect charge is introduced into the over-ignition opening to at least partially close the over-ignition opening after combustion of the over-ignition charge and by combustion residue of the over-ignition charge, and to reduce or dampen a propagation of a pressure shock which is produced as a result of an ignition of the effect charge in the effect chamber and acts on the delay chamber via the over-ignition opening.

2. The pyrotechnic object according to claim 1, wherein the over-ignition charge is introduced into the over-ignition opening over at least 20%, of the length of the over-ignition path.

3. The pyrotechnic object according to claim 1, wherein the over-ignition charge is pressed into the over-ignition opening.

4. The pyrotechnic object according to claim 1, wherein the over-ignition charge is introduced into the over-ignition opening as a pasty medium or a flowable medium and is cured therein.

5. The pyrotechnic object according to claim 1, wherein the over-ignition opening has a cross-sectional change along the over-ignition path.

6. The pyrotechnic object according to claim 5, wherein the cross-sectional change of the over-ignition opening is a cross-sectional area that changes along the over-ignition path by at least 10%.

7. The pyrotechnic object according to claim 5, wherein the cross-sectional change is oriented such that the over-ignition opening has, in an ignition propagation direction towards the effect chamber, an increasing cross-sectional area.

8. The pyrotechnic object according to claim 5, wherein the cross-sectional change is conical-shaped or funnel-shaped.

9. The pyrotechnic object according to claim 5, wherein the over-ignition opening is a stepped opening.

10. The pyrotechnic object according to claim 5, wherein the over-ignition charge is arranged in a region of the cross-sectional change such that immobilization and anchorage of the combustion residue of the over-ignition charge in the over-ignition opening is assisted by the cross-sectional change.

11. The pyrotechnic object according to claim 5, wherein the cross-sectional change of the over-ignition opening is a cross-sectional area that changes along the over-ignition path by at least 25%.

12. The pyrotechnic object according to claim 5, wherein the cross-sectional change of the over-ignition opening is a cross-sectional area that changes along the over-ignition path by at most 60%.

13. The pyrotechnic object according to claim 1, further comprising a housing inner body defining the delay chamber and the effect chamber and an outer sleeve body surrounding the housing inner body, the outer sleeve body having a grippable outer side of the object.

14. The pyrotechnic object according to claim 13, wherein the outer sleeve body is cylindrical.

15. The pyrotechnic object according to claim 13, wherein the outer sleeve body is configured to seal one or more openings communicating with the delay chamber and the effect chamber.

16. The pyrotechnic object according to claim 1, wherein:

the at least one effect chamber includes a plurality of effect chambers accommodating effect charges to be ignited;

the delay chamber is transversely connected to the plurality of effect chambers via a plurality of over-ignition openings including the over-ignition opening; and the plurality of over-ignition openings are arranged successively downstream along the delay path in the order of the effect charges to be ignited.

17. The pyrotechnic object according to claim 1, wherein the over-ignition charge is introduced into the over-ignition opening over at least 30% of the length of the over-ignition path.

18. The pyrotechnic object according to claim 17, wherein the over-ignition charge is introduced into the over-ignition opening over at most 90% of the length of the over-ignition path.

19. The pyrotechnic object according to claim 1, wherein the over-ignition charge is introduced into the over-ignition opening over at least 50% of the length of the over-ignition path.

20. The pyrotechnic object according to claim 1, wherein the pyrotechnic object is one of an irritation body, irritation projectile or ammunition.

* * * * *